US006559575B1

(12) United States Patent
Sakata et al.

(10) Patent No.: US 6,559,575 B1
(45) Date of Patent: May 6, 2003

(54) CATHODE RAY TUBE AND METHOD OF MANUFACTURING THE SAME, AND COLOR SELECTING MEMBER FOR CATHODE RAY TUBE AND METHOD OF MANUFACTURING THE SAME

(75) Inventors: Atsushi Sakata, Kanagawa (JP); Katsutoshi Ohno, Tokyo (JP); Shoichi Muraguchi, Kanagawa (JP); Masamichi Okada, Kanagawa (JP); Takahiro Inoue, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/568,131

(22) Filed: May 10, 2000

(30) Foreign Application Priority Data

May 18, 1999 (JP) ..... 11-137694

(51) Int. Cl.[7] ..... H01J 29/46
(52) U.S. Cl. ..... 313/2.1; 313/403
(58) Field of Search ..... 313/402, 403, 313/407, 408, 2.1; 220/2.3 A, 2.1 A

(56) References Cited

U.S. PATENT DOCUMENTS 3,888,673 A * 6/1975 Suzuki et al. ..... 313/403
4,066,923 A * 1/1978 van Esdonk ..... 313/402

FOREIGN PATENT DOCUMENTS

| | | | |
|---|---|---|---|
| EP | 0381442 | 8/1990 | ..... H01J/9/227 |
| WO | 9934394 | 7/1999 | ..... H01J/31/20 |

OTHER PUBLICATIONS

A.A.S. Sluyterman, *23.4: The Camel CRT*, SID International Symposium Digest of Technical Papers, US, Santa Ana, CA, vol. 29, pp. 351–354, May 17, 1998.

* cited by examiner

*Primary Examiner*—Ashok Patel
(74) *Attorney, Agent, or Firm*—Jay H. Maioli

(57) ABSTRACT

A cathode ray tube and a color selecting member, which can be manufactured without defects by using an existing projection aligner of a simple structure and can always produce a picture of high quality, in which phosphor layer has a pattern in stripes in the lateral direction of a screen, or in the horizontal direction and a color selecting member has slits elongated in the longitudinal direction of the screen, or in the horizontal scan line direction. Even in case of the thermal expansion of the color selecting member or a considerable longitudinal deviation between the exposure position at the time of manufacture and the position where an electron beam strikes in actual use, an electron beam can freely pass through the slits. Therefore, the accuracy of irradiation of the phosphor layer with the electron beam is not adversely influenced.

3 Claims, 11 Drawing Sheets

CATHODE RAY TUBE AND METHOD OF MANUFACTURING THE SAME, AND COLOR SELECTING MEMBER FOR CATHODE RAY TUBE AND METHOD OF MANUFACTURING THE SAME

BACKGROUND OF THE INVENTION

1. Field of the Invention

The present invention relates to a cathode ray tube (CRT) used as, for example, a color television or a display device for an information processing terminal device, and a method of manufacturing the CRT. The present invention also relates to a color selecting member for a CRT, for ensuring that an electron beam strikes a predetermined position in a phosphor pattern, and a method of manufacturing the color selecting member.

2. Description of the Related Art

A CRT is used as a usual type of color television receiver of the related art or a display device for an information processing terminal device. For the purpose of achieving a CRT of high picture quality by solving problems such as a chromatic blur of neighboring color pixels, there is provided a color selecting member such as an aperture grille or a shadow mask. Such a color selecting member is used for exposure to form patterns for respective color phosphors in a self aligning manner. Based on the patterns formed by exposure, phosphor patterns corresponding to respective color pixels are formed by photolithography or the like.

In recent years, the size of a screen, especially in a color television receiver, has been increasing. On the other hand, a color television receiver adapted to a high definition display system, what is called a HDTV (high definition television) system, is being developed and put into practical use. Enlarging the entire screen in such a color television receiver involves an increase in the size of the entire CRT.

In the case of a CRT for HDTV, since its screen is further widened especially in the lateral direction (horizontal scan direction), the size of the CRT in the lateral direction is remarkably increased. The CRT for HDTV has to therefore provide for upsizing especially in the lateral direction (horizontal direction). On the other hand, since the CRT for HDTV is a display device for the purpose of higher picture quality in a high definition display system, the CRT for HDTV requires higher picture quality while upsizing.

In such a CRT of the related art, especially a color selecting member and a phosphor layer are manufactured in the following manufacturing process.

FIG. 5 is a schematic diagram showing a process of exposure to form a phosphor layer in a process of manufacturing a usual single-gun type of CRT of the related art. The Description given below relates to the case of a CRT using a phosphor pattern in vertical stripes and a color selecting member (that is, aperture grille) of the related art.

Referring to FIG. 5, a photosensitive agent (not shown) such as resist is applied to the inside of a front panel 1. A color selecting member 2 is mounted just behind the front panel 1. The color selecting member 2 has narrow slits or a number of rectangular holes arranged in a slot pattern or in a dot pattern. Then, the front panel 1 is exposed through the color selecting member 2 so as to form a pattern for carbon stripes having predetermined widths and pitches in predetermined positions. After that, carbon is applied and dried, and the stripes of the photosensitive agent are removed with a chemical (or a solvent) such as hydrogen peroxide, thereby forming carbon stripes.

A film made of a mixture of each color phosphor, namely, for example, R (Red), G (Green) and B (Blue), and the photosensitive agent is formed and exposed with the exposure position shifted so as to form a pattern in vertical stripes having predetermined widths and pitches in predetermined positions. The pattern formed by exposure is used to form stripes (not shown) of each color phosphor by photolithography. Thus, a phosphor layer is completed.

When the CRT is used as a completed product in practice, an electron beam emitted from an electron gun strikes accurately its intended area in the phosphor layer formed as mentioned above. Thereby, the color phosphor at the intended position emits light and is observed as a pixel. In order to attain high picture quality, the phosphor has to be formed in an exact position where the electron beam strikes. In other words, a deviation of the phosphor from the exact positioning causes defective display such as misregistration, which deteriorates picture quality severely. The demands on exact positioning of the phosphors are becoming even severe in order to cope with higher definition attained in recent years.

For the purpose of accurate positioning of the light for exposing a phosphor and the electron beam, provided is a correction lens system 4 between a light source 3 of a projection aligner and the front panel 1 (more concretely, the phosphor layer). Thereby, a deviation between the locus of the electron beam and that of the light for exposure is corrected. The correction lens system 4 has an uneven shape in cross section as shown in FIG. 5.

In recent years, while the size of the screen is increasing as described above, reduction in a depth dimension has been strongly demanded in the outer shape of the entire television receiver. Since there is a tendency that the size of the entire CRT has to be increased as the size of the screen increases, the depth dimension of the CRT tends to increase. That is, it goes counter to the demand on reduction in a depth dimension of the outer shape.

Particularly in the case of a CRT adapted to a large screen, especially a CRT for HDTV of a wider screen, further reduction in a depth dimension of the CRT is almost impossible in the single-gun type of CRT. Thus, as shown in FIG. 6, there has been a proposal for a CRT in which two or more electron guns 5 are arranged side by side in the lateral direction. The electron guns 5 are housed in the respective necks 7 of the respective rear funnels 6. Deflection yokes 8 are provided around the respective necks 7 in correspondence with the respective electron guns 5.

The use of a plurality (two in this case) of electron guns 5 in side-by-side arrangement as mentioned above enables an electron beam emitted from each electron gun 5 to move across only about half of the screen. This enables an electron beam to strike especially in the peripheral areas of the screen at a reasonable angle, even if a depth dimension is reduced by shortening the distance between the electron gun 5 and the front panel 1. Thus, a depth dimension of the outer shape is reduced while being adapted to the large screen. In addition, high picture quality can be achieved throughout the entire large screen.

Since a usual type of CRT of the related art has one electron gun 5, a projection aligner used in the manufacturing process also adopts a system in which one light source corresponds to one front panel.

FIG. 7 shows a CRT for large HDTV, as an example of a large CRT having an extremely wide screen, during the process of exposure to form a phosphor layer by using a usual type of projection aligner of the related art having only one light source system 3 in only one place. The portion in FIG. 7 denoted by reference character A is shown in FIG. 8 in enlarged dimension. As seen from FIG. 8, the use of a usual type of projection aligner of the related art causes a considerable deviation of the locus of light 9 for exposure and that of an electron beam 10 from each other.

The reason is as follows. The number of electron guns for emitting the electron beam 10 is two while there is provided one light source system 3. This causes a large difference between the incident angle of the electron beam 10 and that of the light 9, which pass through the same single hole 11 in the color selecting member 2. As a result, there is a considerable deviation of the position of each color phosphor or each pixel phosphor formed in the photolithography process including the exposure process using the light 9 from the position where the electron beam 10 strikes. This produces problems of deterioration in picture quality and occurrence of display failure.

One possible method to cope with the problem may be, as shown in FIG. 9, to modify the projection aligner for the manufacture of the multiple-gun CRT by adapting to the number of the electron guns and their disposing positions in the CRT to be manufactured.

It is, however, impossible to adopt such a method in practice by using the existing exposure stage as it is. Either the existing exposure stage is extremely largely modified or a new projection aligner has to be manufactured. This causes an increase in manufacturing cost. Moreover, in the case of taking the trouble and manufacturing a projection aligner having a plurality of light sources 3, the structure becomes more complicated than the related art structure. High precision in positioning is required in the joint area of the phosphor layers formed by using the respective light sources 3. Thus, high accuracy of the projection aligner itself is strictly demanded, causing a problem that the manufacture and handling at the time of operation in the exposure process, and so on are complicated.

To be specific, when light from the light sources 3 in two places as shown in FIG. 9 is emitted for exposure, the two areas irradiated by the light from the respective light sources are joined in a central part 12 of a screen. This requires extremely precise control of the alignment (positioning) at the time of exposure in the joint part.

In the CRT, however, as is outstanding especially in the case of the HDTV or the like, the definition is becoming higher and the number of pixels is further increasing. Consequently, there is a problem of an extremely high probability that the phosphor patterns are deviated in position or deformed in the joint area of the two areas exposed to the light from the respective light sources.

Specifically, it is known that when the position of the light source 3 is deviated by 0.1 mm, the position of the phosphor pattern is deviated by about 5 $\mu$m. The deviation of 5 $\mu$m with respect to the size of pixels of high density achieved in recent years is observed as relatively serious misregistration on a screen in actual use, as compared with the size of one pixel. This problem becomes even more serious if the positional deviation or deformation of the phosphor patterns occur in the joint area at the time of exposure, resulting in a conspicuous deterioration in picture quality in the central area of the screen of the CRT. This causes a critical defect in a display device.

In order to prevent the occurrence of defects in the joint area at the time of exposure, not only higher accuracy in mounting the light source 3 or machining the correction lens 4 but also closer control on the dimensional accuracy of the entire projection aligner are necessary. This causes a problem that the manufacture of the projection aligner, handling at the time of the operation of the projection aligner, and so on become very complicated.

Furthermore, since the joint area is irradiated with the light 9 from both of the two light sources, the photosensitive agent such as resist in the joint area is exposed double as compared with the photosensitive agent in the other area. Consequently, there is an extremely high probability that the patterns in the joint area are of different shapes and dimensions from those in the other area. This results in a problem that the pixels in the joint area, as distinct from those in the other area, are observed as display failure or defective display.

SUMMARY OF THE INVENTION

The present invention has been achieved in consideration of the problems. An object of the present invention is to provide a cathode ray tube and a method of manufacturing the cathode ray tube, and a color selecting member for use in the cathode ray tube and a method of manufacturing the color selecting member, which can be manufactured without a defect by using an existing simple structured projection aligner and can always produce a picture of high quality by solving a problem of occurrence of display failure or defective display due to relative deviation of the positions of an electron beam striking a phosphor at a certain incident angle, a hole or a slit in a color selecting member for allowing the electron beam to pass through, and a phosphor.

A cathode ray tube of the present invention comprises: an electron gun for emitting an electron beam for scanning; a panel disposed so that a back side of the panel faces the electron gun; a color selecting member which is disposed between the back side of the panel and the electron gun, has a slit elongated in the same direction as the longitudinal direction of the outer shape of the panel, and allows the electron beam for scanning to pass through the slit; and a phosphor layer which is provided on the back side of the panel and has a pattern in stripes corresponding to the shape of the slit in the color selecting member so as to be irradiated with the electron beam passed through the slit in the color selecting member.

A method of manufacturing a cathode ray tube of the present invention comprises steps of: forming a phosphor material layer on the back side of a panel on which a picture is produced; mounting behind the panel a color selecting member having a slit elongated in the same direction as the longitudinal direction of the outer shape of the panel, and forming a phosphor layer having a pattern in stripes in the same direction as the longitudinal direction of the outer shape of the panel by patterning the phosphor material layer using the color selecting member as a mask.

The slit in the color selecting member for the cathode ray tube of the invention has a shape elongated in the same direction as the longitudinal direction of the outer shape of the color selecting member.

According to the present invention, a method of manufacturing a color selecting member for a cathode ray tube comprises steps of: forming a photosensitive material layer on a material for forming the color selecting member for the cathode ray tube; exposing the photosensitive material layer by irradiating the photosensitive material layer with light from a light source in one place to form a latent image of a slit pattern on the photosensitive material layer, the slit pattern elongated in the same direction as the longitudinal direction of the outer shape of the color selecting member for the cathode ray tube; and forming a slit elongated in the same direction as the longitudinal direction of the outer shape by developing the latent image of the slit pattern and patterning the material based on the slit pattern.

In the cathode ray tube or the method of manufacturing the cathode ray tube according to the present invention, the slit in the color selecting member is elongated in the longitudinal direction of the color selecting member itself. That is, the slit is elongated in the longitudinal direction of a display panel, while a display panel is generally in landscape orientation. In the meantime, the stripe pattern of the phosphor layer is formed so as to correspond to the shape of the slit in the color selecting member.

As a result, even in a case where there are a plurality of electron guns for emitting electron beams and one light source system of light emitted at the time of exposing the phosphor, as distinct from the related art, no deviation occurs between the position of the phosphor and the actual position irradiated with the electron beam. This enables exposure using only one light source (in one position). No joint areas or the like are formed on the screen by light sources at the time of exposure, eliminating a problem such as a positional deviation.

The color selecting member has only the slit elongated in the same direction as the longitudinal direction of the. outer shape of the color selecting member. There are no vertical patterns which substantially disturb passage of electron beams in the slit extending from the right end to the left end across the screen. Even in case of a considerable horizontal deviation due to, for example, the thermal expansion of the color selecting member, the electron beam passes through the slit elongated horizontally, and the accuracy of irradiation of the phosphor with the electron beam is not adversely influenced. Therefore, the thermal expansion of the color selecting member causes no misregistration in the peripheral area nor non uniform display between the central area and the peripheral area. This enables complete prevention of occurrence of defective display such as misregistration or display failure, thereby achieving extremely high picture quality, especially in cathode ray tubes which often has a problem of misregistration in the horizontal direction, such as a cathode ray tube with a large screen or a cathode ray tube for HDTV having a screen in landscape orientation of an aspect ratio of 16:9.

Other and further objects, features and advantages of the invention will appear more fully from the following description.

DETAILED DESCRIPTION OF THE PREFERRED EMBODIMENTS

Figure 1:
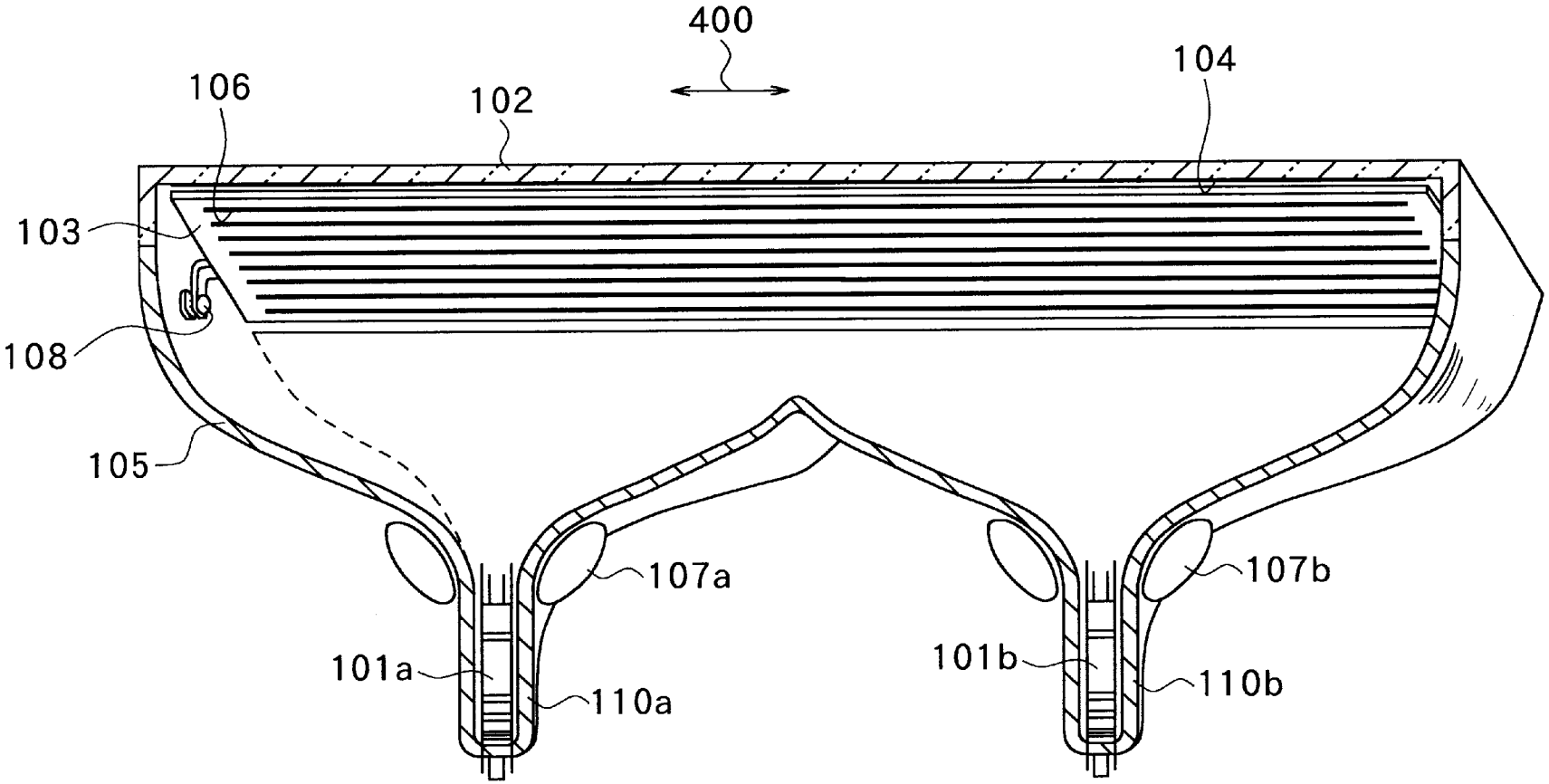
FIG. 1 is a diagram showing a construction of a main part of a cathode ray tube according to an embodiment of the invention.

Embodiments of the present invention will now be described in detail hereinbelow by referring to the drawings.

Figure 2:
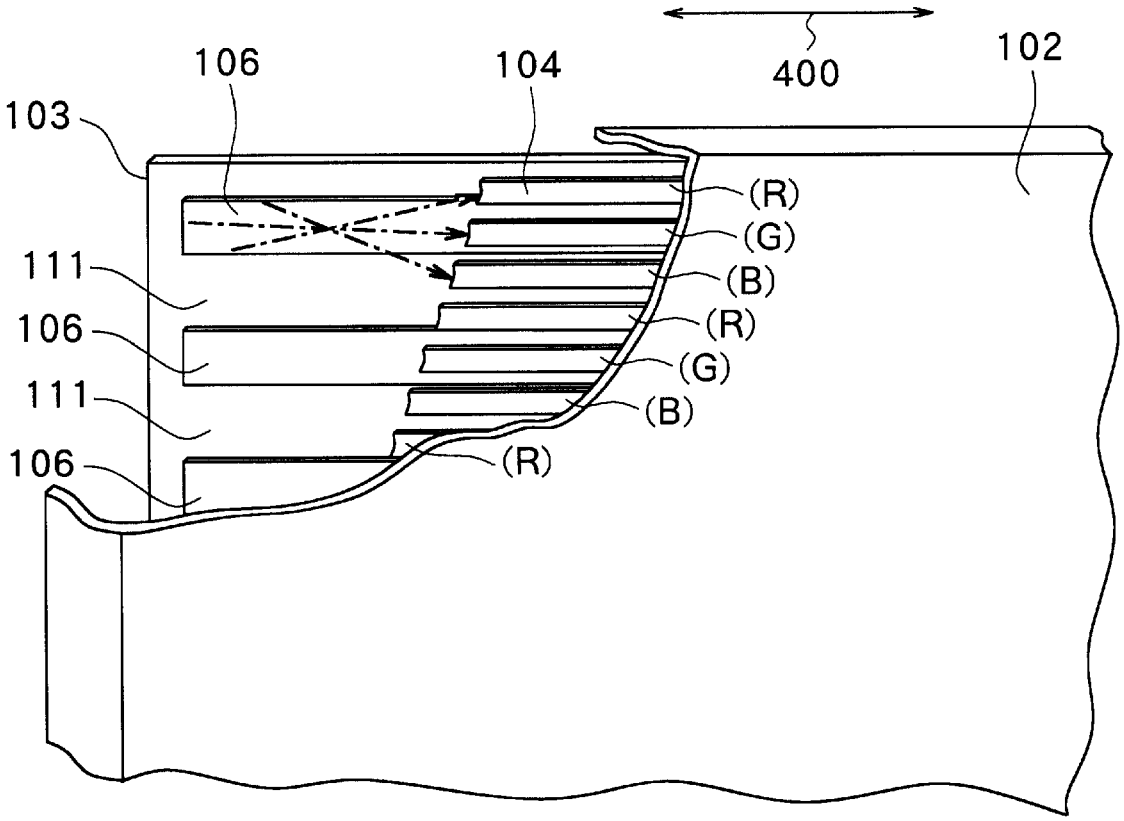
FIG. 2 is an enlarged diagram of the main part of the cathode ray tube shown in FIG. 1, especially of a front panel.
Figure 3:
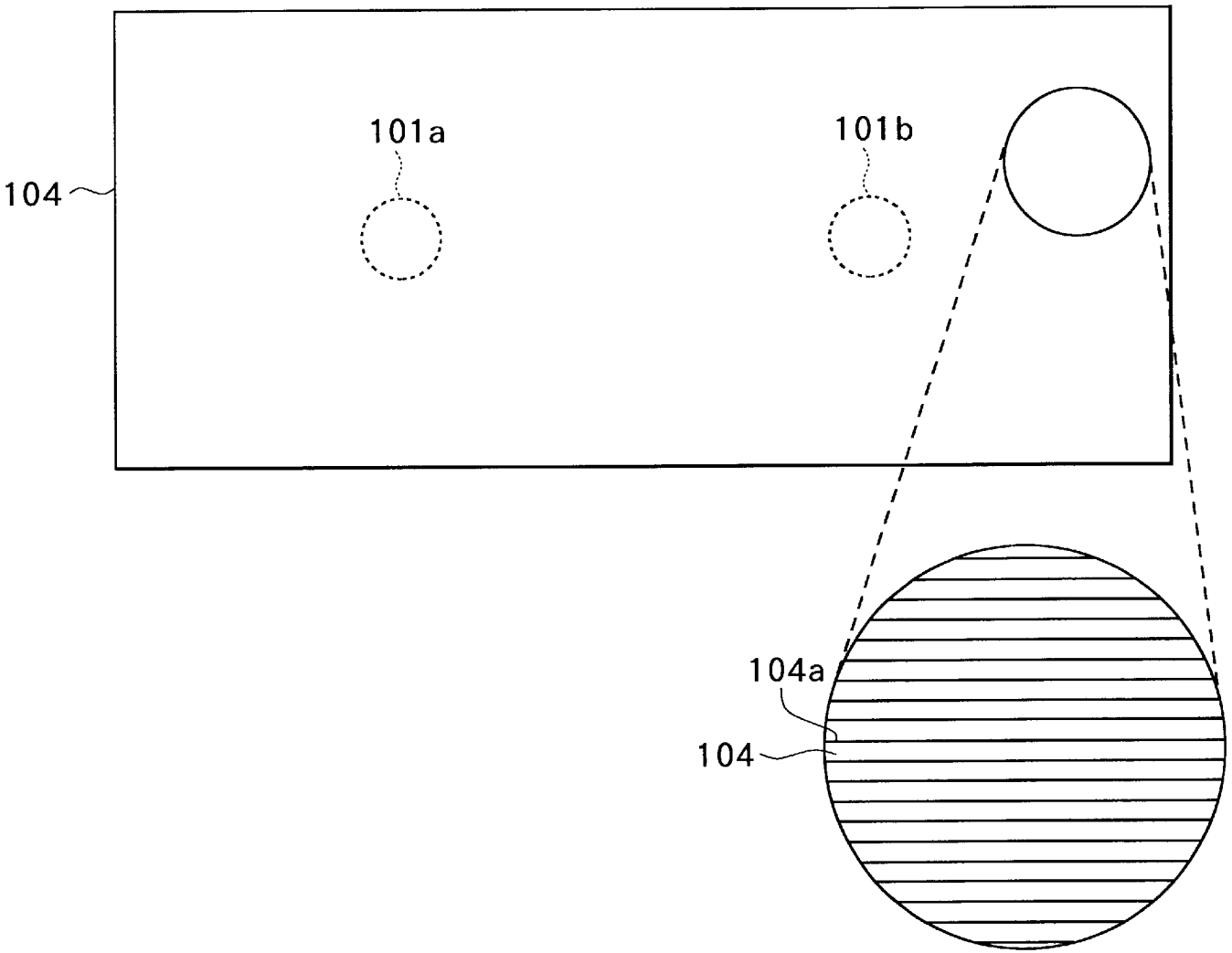
FIG. 3 is a diagram for explaining the construction of a phosphor layer formed in the cathode ray tube of FIG. 1.
Figure 4:
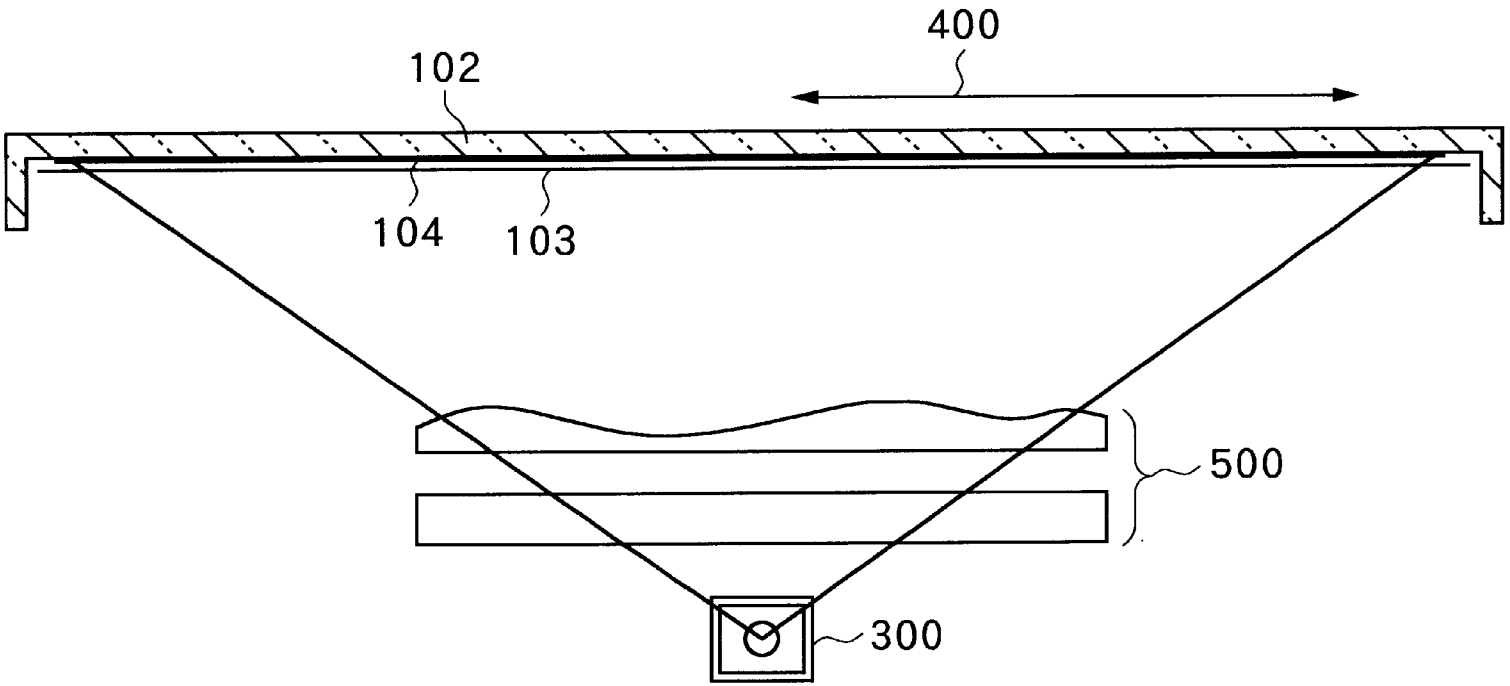
FIG. 4 is a schematic diagram for explaining a projection aligner used in a process of exposure to form the phosphor layer shown in FIG. 3 and an exposing method using the projection aligner.
Figure 5:
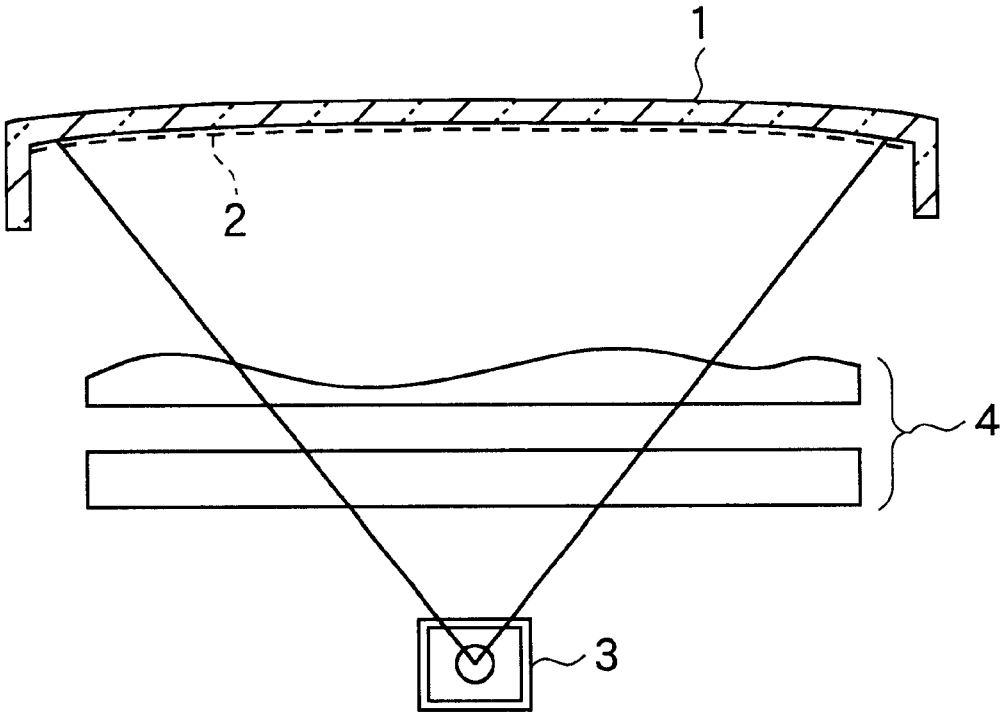
FIG.5 RELATED ART
FIG. 5 is a diagram for explaining a process of manufacturing a usual single-gun type of cathode ray tube of the related art, especially a process of exposing the phosphor layer.
Figure 6:
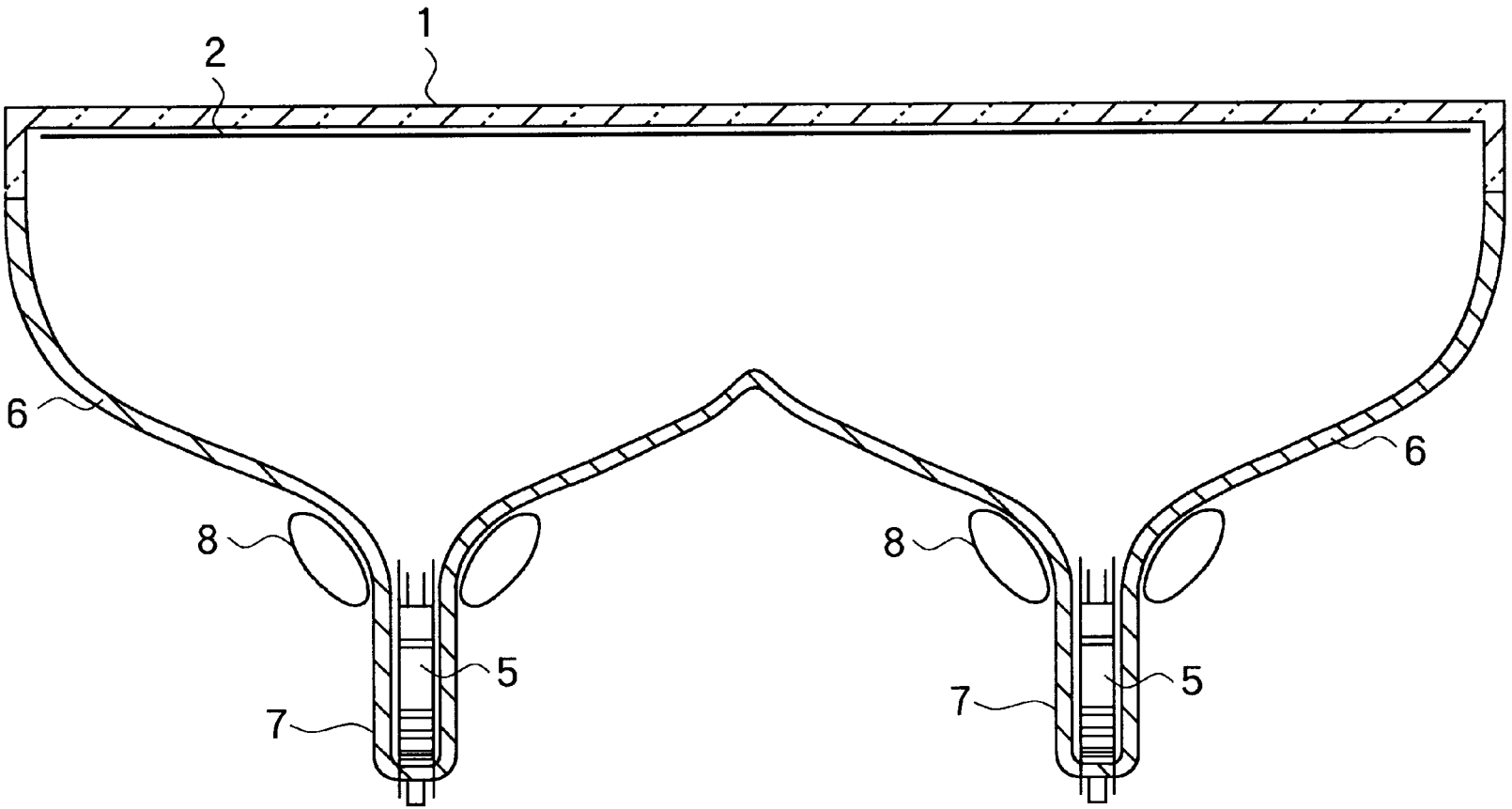
FIG.6 RELATED ART
FIG. 6 is a diagram showing an example of a cathode ray tube of a type in which two electron guns are arranged side by side especially in the lateral direction.
Figure 7:
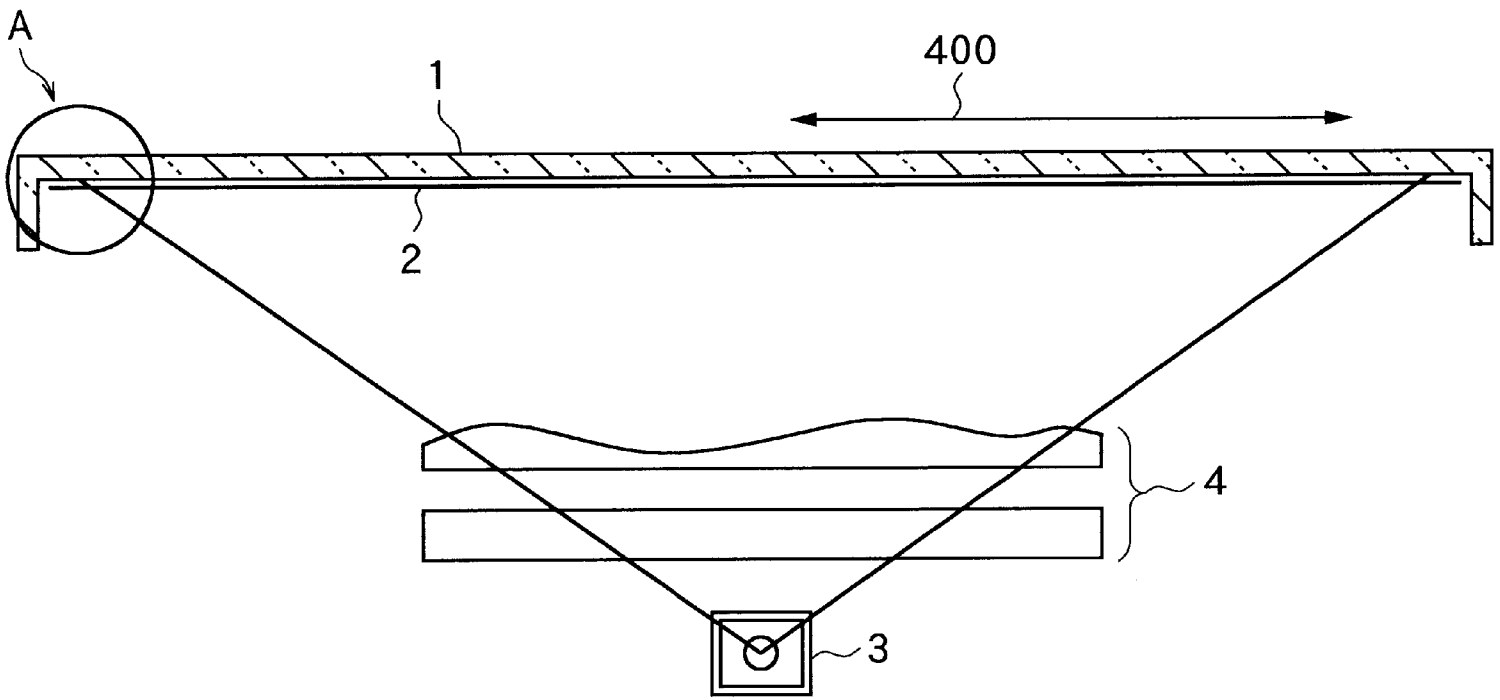
FIG.7 RELATED ART
FIG. 7 is a diagram for explaining an example of the use of a usual type of projection aligner of the related art having only one light source system.
Figure 8:
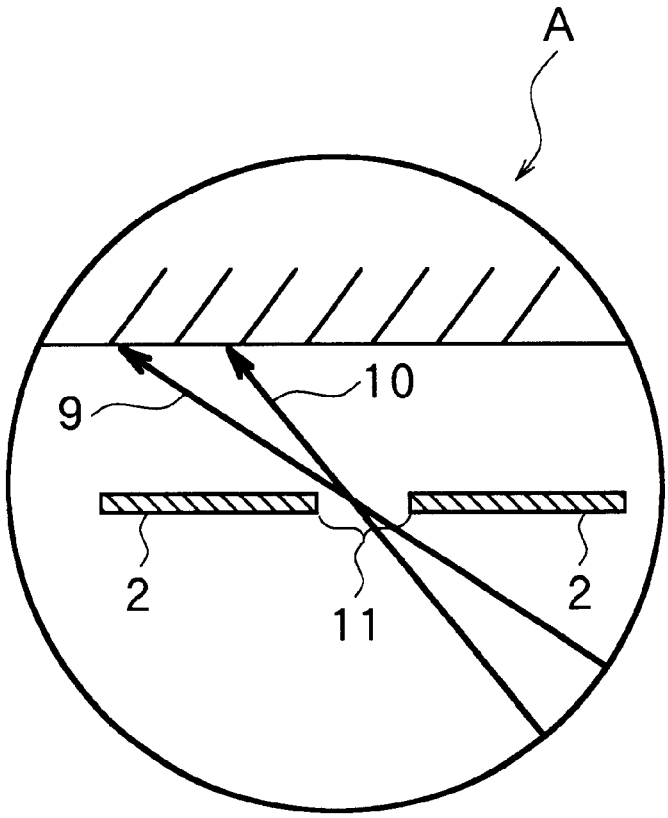
FIG.8 RELATED ART
FIG. 8 is an enlarged schematic diagram showing a portion in FIG. 7 denoted by reference character A.
Figure 9:
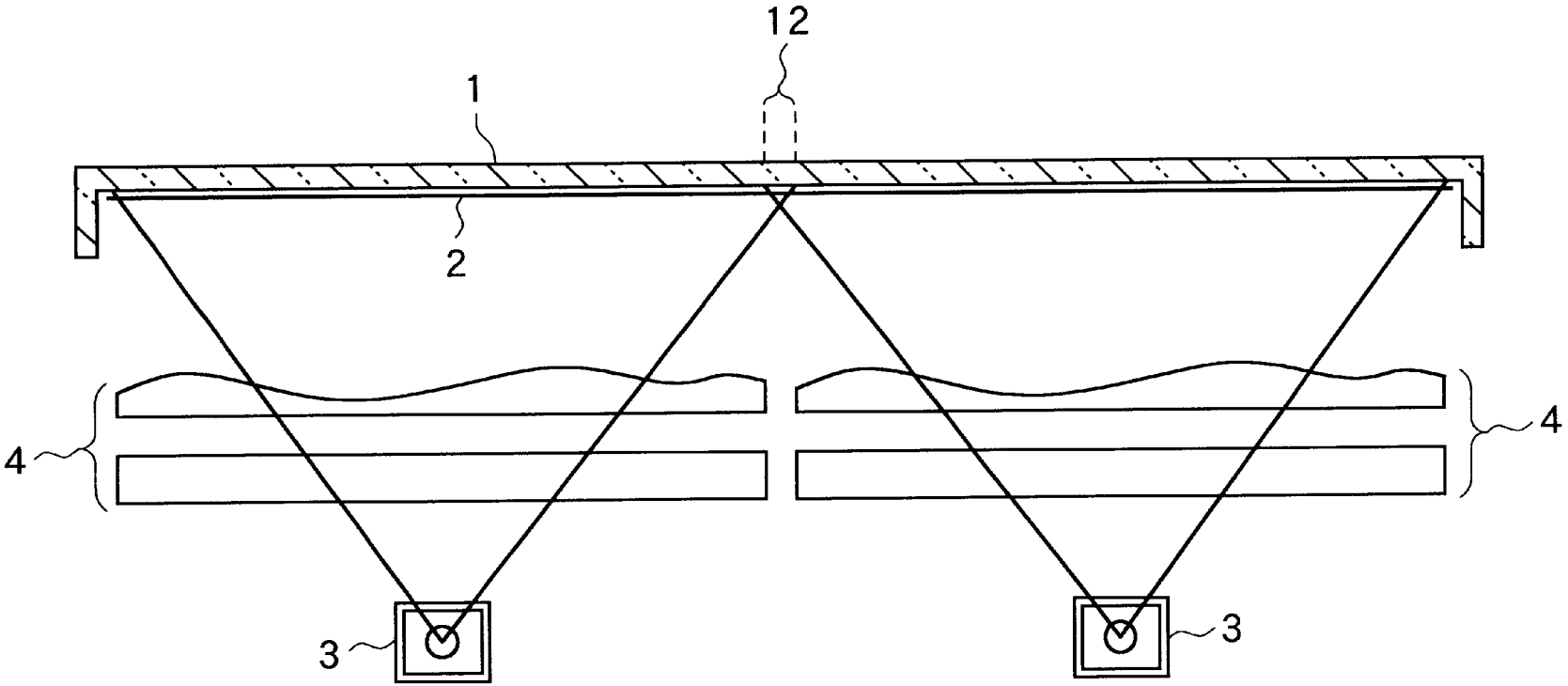
FIG.9 RELATED ART
FIG. 9 is a diagram for explaining an example of an exposing method using a plurality of light sources corresponding to the number and disposing positions of electron guns.

FIG. 1 schematically shows the construction of the main part of a cathode ray tube according to an embodiment of the present invention. FIG. 2 schematically shows the construction of the main part of the cathode ray tube, especially a front panel in enlarged dimension. FIG. 3 shows a pattern of a phosphor layer used in a cathode ray tube. FIG. 4 is a diagram showing a projection aligner used in particularly a process of exposure to form the phosphor layer and an exposing method using the projection aligner.

The cathode ray tube comprises: a plurality of, for example, two electron guns 101*a* and 101*b;* a front panel 102 disposed so that its back side faces the two electron guns 101*a* and 101*b;* a color selecting member 103 disposed apart from the front panel 102 with a gap of about a few millimeters to tens of millimeters; and a rear funnel 105 which is combined with the front panel 102 to form a sealed vessel structure. The rear funnel 105 is provided with two necks 110*a* and 110*b,* around which deflection yokes 107*a* and 107*b* are provided, respectively. The electron guns 101*a* and 101*b* are housed in the necks 110*a* and 110*b,* respectively.

Each of the two electron guns 101*a* and 101*b* may emit three electron beams corresponding to the three primary colors of R (Red), G (Green) and B (Blue) while the electron beams scanning the screen in the horizontal direction (lateral direction of the screen) as denoted by reference numeral 400 or in the vertical direction. In the case of scanning in the horizontal direction, it is obviously to be noted that it may be necessary to prevent rasters of horizontally neighboring pixels from blurring.

The "horizontal direction" as used herein refers to the longitudinal direction of the screen called "horizontal scan direction" in an image display device using a usual type of CRT, that is, what is called a television. The "vertical direction" as used herein denotes a direction orthogonal (or perpendicular) to the horizontal direction. Based on these definitions of the "horizontal direction" and the "vertical direction", the outer shape of the screen of a display device such as a television is generally elongated in the horizontal direction. The definitions of the directions used as the reference are obtained as mentioned above for the following reason. The application of a cathode ray tube is to a display device such as a television for displaying an image visible to human eyes and recognizable as an image. Since sight of a human in a normal posture is generally oriented in landscape, the outer shape of the screen of a television or the like is formed so as to be adapted to the orientation of human sight. However, in the cathode ray tube and the color selecting member for a cathode ray tube according to the present invention, as described above, the actual scan direction of the electron beam is not limited to what is called the "horizontal scan direction" or the "horizontal direction" in the definition above. The electron beam may also scan in the "vertical direction".

In the embodiment, the electron guns 101*a* and 101*b* are spaced apart in the horizontal direction in a side-by-side arrangement. Preferably, the electron guns 101*a* and 101*b* are so-called single-tube in-line three-beam electron guns. Electron guns of this type have the advantages of hardly requiring convergence adjustment, simplicity of structure and high accuracy of emitting electron beams. In the embodiment, however, the three muzzles, each emitting an electron beam, are aligned in line in a direction orthogonal to a horizontal in-line alignment of the related art. That is, the three muzzles are aligned in line in the vertical direction. In order to cope with horizontally elongated slits 106 in a color selecting member 103 with the three muzzles aligned in line in the horizontal direction, the three electron beams emitted from the three muzzles of the electron guns may be deflected so as to be adapted to horizontally elongated slits. Detailed description of the color selecting member 103 will be given below.

The color selecting member 103 is disposed between the front panel 102 and the electron guns 101*a* and 101*b*. More particularly, the color selecting member 103 is mounted behind the front panel 102 with a gap of about a few millimeters to tens of millimeters. The four longitudinal and lateral sides of the color selecting member 103 are resiliently supported by a spring structured supporting member 108 within the outer frame of the front panel 102. In the color selecting member 103, slits 106 which are elongated in the same direction as the longitudinal direction of the color selecting member 103 are formed. The electron beams emitted from the electron guns 101*a* and 101*b* are allowed to pass through the slits 106.

Between the front panel 102 and the electron guns 101*a* and 101*b*, and particularly on the back side of the front panel 102, a phosphor layer 104 is formed. When the phosphor layer 104 is irradiated with an electron beam, the irradiated part produces light toward the surface side of the front panel 102. As shown in FIG. 3 in enlarged dimension, the phosphor layer 104 is formed as a phosphor pattern in horizontal stripes in correspondence with the shape of the slits 106 in the color selecting member 103. Thus, the pattern of the phosphor layer 104 is irradiated with an electron beam passed through the slits 106 in the color selecting member 103. The phosphor layer 104 has horizontal phosphor stripes 104*a* in order from the top to the bottom of the phosphor layer 104 like R, G, B, R, G, B, R, G, B, and so on, as indicated by (R), (G), (B), and so on in FIG. 2.

As mentioned above, in the embodiment, the phosphor layer 104 has a phosphor pattern in stripes in the lateral direction of the screen, that is, in the horizontal direction. The color selecting member 103 also has the slits 106 elongated in the longitudinal direction of the screen, that is, in the horizontal direction. Consequently, the color selecting member 103 has no vertical pattern which substantially disturbs the passage of an electron beam in the slits extending from the right end to the left end across the screen.

Even in case of a considerable positional deviation longitudinally of the outer shape of the color selecting member 103 due to the thermal expansion or the like, an electron beam can freely pass through in the direction above, and there is no adverse influence on the accuracy of irradiation of the phosphor layer 104 with the electron beam. The thermal expansion of the color selecting member 103 according to the embodiment causes no misregistration in the peripheral area nor non uniform display between the central area and the peripheral area when incorporated and used in a cathode ray tube. The description above applies both to a case of horizontal scanning with the electron beam in the so-called horizontal scan direction and to a case of scanning in a direction orthogonal to the horizontal scan direction, i.e. vertical scanning.

On the other hand, a cathode ray tube used for HDTV has a wider screen especially in the horizontal direction. Moreover, in the case of an NTSC television receiver of the related art as well, the screen is generally large, and high definition and high picture quality are required. This results in a large width dimension of the screen in absolute value. This leads to a conclusion that a cathode ray tube for HDTV or the like becomes even wider in outer shape.

A further increase in the width of the screen makes the problem of a cumulative positional deviation in the lateral direction due to the thermal expansion of the color selecting member more outstanding. This results in defective display or display failure in the related art. An example of defective display is a noticeable difference in luminance or contrast between the right or left end area and the central area of the screen. An example of display failure is a dark spot at which no light is produced on the screen.

A specific example is the case of a cathode ray tube using so-called a shadow mask having a number of holes in a dot pattern. When a large shadow mask, especially a wide shadow mask, is used for the cathode ray tube in practice, the temperature in the cathode ray tube increases due to the irradiation energy of the electron beam, an energy of secondary light emitted from the phosphor or the shadow mask, and the like. This temperature rise causes the expansion of the entire shadow mask, resulting in a positional deviation between the dot pattern (holes) of the shadow mask and that of the phosphor as the temperature rises. Such a positional deviation causes defective display such as a remarkable difference in luminance and contrast between the right and left end areas and the central area of the screen or display failure such as a dark spot at which no light is produced on the screen in the right and left end areas.

The problem of the positional deviation caused by the thermal expansion commonly occurs in varying degree in a shadow mask having slots, a stripe pattern or slits, as well as a shadow mask having holes in a dot pattern. The related art practices followed in suppressing as much as possible the thermal expansion of the shadow mask due to the temperature rise and reducing the positional deviation as much as possible have been as follows. One has been to form the shadow mask made of a less expansible material such as a metal material called Invar. Another has been to devise the shape in cross section of each dot of the shadow mask.

The technical measures for the thermal expansion, however, are approaching the limit. Moreover, there is a tendency that the hole, slit, or the like in the color selecting member such as a shadow mask is becoming finer so as to be adapted to the higher definition. There is also a tendency that exacting dimensions is further requested. Moreover, the size of the screen is further increasing. As a result, a cumulative deviation of the irradiation position of the electron beam caused by the thermal expansion becomes further remarkable. This makes the problem of defective display more serious, for example, a noticeable difference in luminance or contract between the right and left end areas and the central area of the screen, or so-called misregistration. Also, various analyses of cathode ray tubes of the related art has revealed that display failure occurs because the electron beam does not pass through the holes or slits, and are blocked and shielded by the color selecting member, and does not allow the intended pixel (phosphor) to emit light.

Although the screen size is not increased, in the case of the cathode ray tube for displaying a high-definition picture such as a CRT for HDTV, the screen is wider than the related art type of screen. In addition, the number of pixels arranged in the lateral direction of the wide screen is twice or more as many as that of the related art type of screen. Therefore, further reduction in size of each pixel and further increase in accuracy is required. Since the outer shape of the screen is generally in landscape orientation, the absolute value in the lateral direction of the outer shape dimension is larger than that in the vertical direction. In such a case as well, the thermal expansion of the color selecting member is likely to cause a positional deviation especially in the lateral direction. Even a slight positional deviation of the holes (or slits) in the color selecting member causes considerable adverse influence on fine pixels. In the related art of the cathode ray tube, therefore, also in the case where the screen size is not large but the cathode ray tube is adapted to high definition, there is a problem that defective display or display failure is likely to occur especially in both ends in the lateral direction.

Figure 10A:
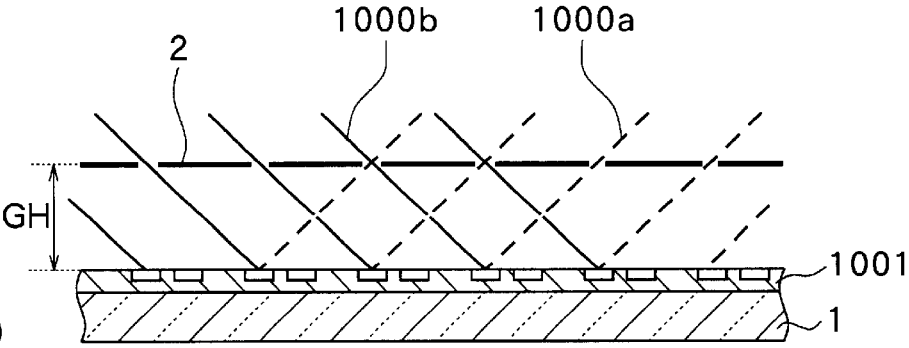
FIG.10A RELATED ART
FIGS. 10A and 10B are diagrams for explaining an example of a positional deviation of an electron beam in a cathode ray tube of the related art.
Figure 10B:
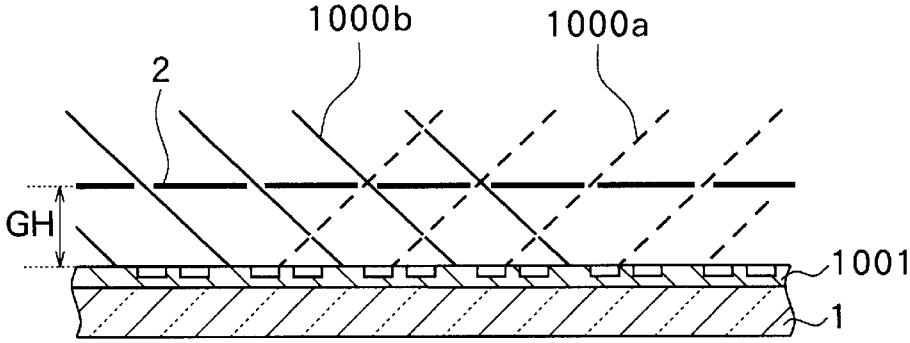
FIG.10B RELATED ART

It has been confirmed that problems similar to the above are also caused by other factors. As an example shown in FIGS. 10A and 10B, a deviation of a distance (referred to as grille height hereinbelow) GH between the color selecting member 2 such as an aperture grille and the front panel 1 from a design value also causes the problem of a remarkable deviation of the irradiation positions of electron beams 1000*a* and 1000*b* emitted from the right and left electron guns respectively. This problem is serious especially in the center area of the screen. FIG. 10A shows a case where the grille height GH is according to the design value. On the other hand, FIG. 10B shows a case where the grille height GH is smaller than the design value. A possible reason for a deviation of the grille height GH from the design value is as follows.

In the process of exposure to form a phosphor layer 1001 by using the color selecting member 2 as a mask, there is a little influence of heat, which brings about a state as shown in FIG. 10A. However, when the cathode ray tube is actually used, the color selecting member 2 is thermal expanded by being heated by the energy of electron beams 1000 emitted. Thus, the color selecting member 2 juts toward the front face, causing a deviation of the grille height GH from the design value as shown in FIG. 10B. Such an error or deviation of the grille height GH causes a deviation of the irradiation positions of the electron beams 1000*a* and 1000*b* emitted from the right and left electron guns respectively, resulting in misregistration. Another reason for a deviation of the grille height GH from the design value is that the color selecting member 2 is not mounted with high accuracy in the formation of stripes in the phosphor face. Thus, the related art requires close control of the grille height GH, which has been very complicated.

In contrast, the embodiment can solve the problem above as well. Specifically, even in case of a considerable positional deviation in the longitudinal direction, that is, in the horizontal direction due to the thermal expansion of the color selecting member 103, the color selecting member 103 in the present embodiment allows electron beams to freely pass through the slits in the color selecting member 103 in the horizontal direction. Thus, the irradiation accuracy of the phosphor layer 104 with the electron beam is not adversely influenced.

Figure 11A:
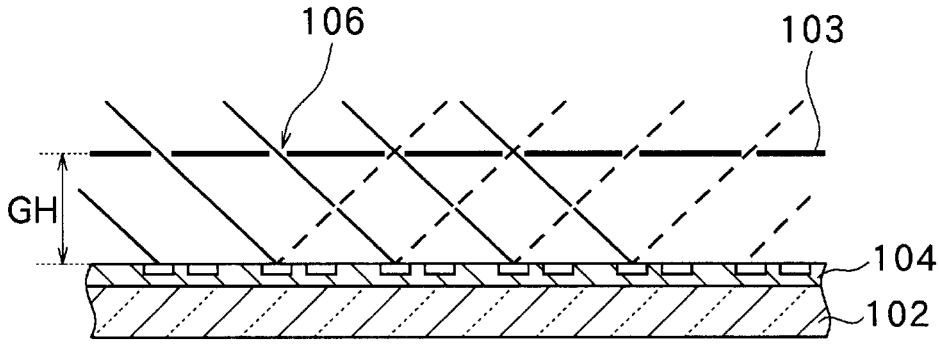
FIGS. 11A and 11B are diagrams for explaining irradiation states of electron beams in the cathode ray tube of the invention.
Figure 11B:
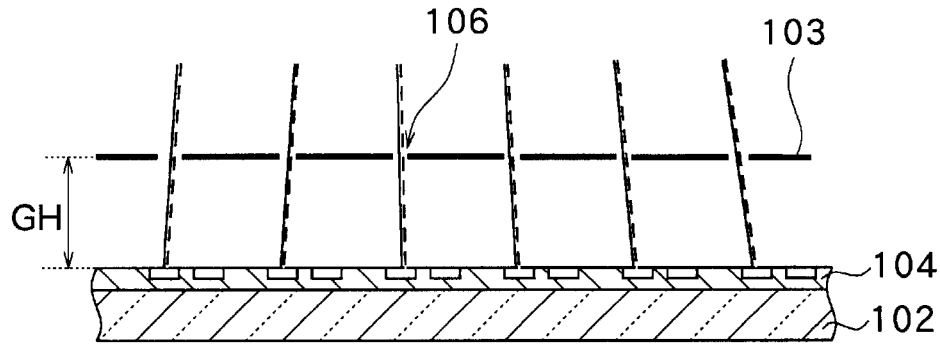

In other words, as shown in FIGS. 11A and 11B, there occurs no deviation of the irradiation positions of the electron beams 1000*a* and 1000*b* emitted from the right and left electron guns. Even when the color selecting member 103 juts toward the front face due to thermal expansion or the like and the grille height GH is deviated from the design value, there is no influence of the deviation. Thus, defective display or display failure is completely diminished, such as misregistration in the peripheral areas, non uniform display between the center area and the peripheral areas of the screen. FIG. 11A is a diagram as seen in the direction orthogonal to the slits in the color selecting member 103 while FIG. 11B is a diagram as seen in the longitudinal direction of the slits.

Reference is now made to FIGS. 1 to 4, describing the process of manufacturing the cathode ray tube having the structure above, especially a process of forming the phosphor layer 104 having a pattern in horizontal stripes and a process of manufacturing the color selecting member 103 used therefor.

First, a photosensitive agent (not shown) such as resist is applied to the inside of the front panel 102. The color selecting member 103 is mounted behind the front panel 102. The color selecting member 103 has a pattern of horizontal slits as described above. Then, the front panel 102 covered with the photosensitive agent is exposed through the color selecting member 103 in a self aligning manner to form a pattern for carbon stripes having predetermined widths and pitches in predetermined positions. In the embodiment, a light source at the time of exposure is only one light source 300 positioned in one place in an almost center of the front panel 1.

Subsequently, carbon is applied and dried. The stripes of the photosensitive agent are removed with an inverting agent such as hydrogen peroxide, thereby carbon stripes in the horizontal direction are formed. Then a film of a mixture of each color phosphor, namely, for example, R, G and B (Red, Green and Blue) and a photosensitive agent is deposited. Onto the film, a photosensitive agent (not shown) such as resist is applied. The photosensitive agent is exposed in a self aligning manner through the color selecting member 103 with the exposure position shifted so as to obtain a pattern having predetermined widths and pitches in predetermined positions. The pattern formed by exposure is used to form stripes of each color phosphor by photolithography. Thereby, the phosphor layer 104 of the embodiment is completed.

In the embodiment, also in the process of forming the phosphor layer 104, a light source at the time of exposure is only one light source 300 positioned in one place in an almost center of the front panel 1. Finer adjustment of the exposure position can be performed by using a correction lens system 500 for correcting precision in optical processing and alignment, as in the related art.

After completing the phosphor layer 104, the color selecting member 103 is mounted accurately in a predetermined position. The rear funnel 105 is joined to the rear side of the front panel 102, thereby forming a sealed vessel structure. In the rear funnel 105, the electron guns 101*a* and 101*b* are incorporated in the necks 110*a* and 110*b*, respectively. Thus, the main part of the cathode ray tube is completed.

In the manufacturing method of the embodiment, the slits 106 in the color selecting member 103 are elongated longitudinally of the screen oriented in landscape. That is, the slits 106 are elongated in the horizontal direction. Therefore, even when two electron guns 101*a* and 101*b* for emitting electron beams are spaced apart in the horizontal direction in a side-by-side arrangement while the number of the light source system for emitting light at the time of exposure of the phosphor is one, no deviation occurs, as distinct from the related art, between the position of the phosphor and the actual irradiation position of the electron beam.

This enables exposure by using only one light source 300 (in one place). There is no joint area, as distinct from the related art, of areas exposed separately by a plurality of light sources (in a plurality of places). This eliminates the problems of alignment of a plurality of light sources, a positional deviation, and the like. As a result, the phosphor layer 104 having no defect can be manufactured with high accuracy by an extremely simple projection aligner and exposing method.

Description will now be made with regard to a method of manufacturing the color selecting member 103 according to the embodiment.

A photosensitive material layer is applied onto a thin film material for forming the color selecting member 103 for a cathode ray tube. The photosensitive material layer is exposed through a photo mask having a pattern corresponding to the shape of the slits 106, by irradiating the photosensitive material layer with light emitted from a light source in one place in a manner similar to the exposure performed by the projection aligner shown in FIG. 4. The pattern formed by exposure at this time is a pattern having a number of slits elongated in the longitudinal direction of the outer shape of the color selecting member 103, that is, an almost rectangular shape.

Subsequently, a latent image thus exposed is developed to form a pattern for slits. Based on the pattern for slits, the slits 106 in stripes are patterned by photolithography. Thereby, the color selecting member 103 having the horizontal slits 106 can be formed.

The embodiment as described above enables exposure by using only one light source 300 (in one place). Thus, there is no joint area of areas separately exposed by a plurality of light sources (in a plurality of places) at the time of exposure. This eliminates the problems of alignment, a positional deviation, and the like of a plurality of light sources. As a result, by the extremely simple projection aligner and exposing method, the color selecting member 103 having no defect can be manufactured with high accuracy.

Although the present invention has been described by referring to the embodiment, the present invention is not limited to the foregoing embodiment but can be variously modified. For example, the embodiment utilizes single-tube in-line three beam electron guns as the electron guns 110*a* and 110*b* because of the advantages of hardly requiring convergence adjustment, simplicity of structure, and high accuracy of emitting electron beams. However, a three-tube in-line electron gun or a three-tube delta electron gun, or the like can be also used.

Although the embodiment relates to the case of using two electron guns 110*a* and 110*b*, it is obvious that more electron guns may be used. Furthermore, a number of, for example, three, or ten or more electron guns can be arranged in line in the horizontal direction of the screen. On the other hand, a single-gun structure is obviously possible. This structure, however, obviously has a difficulty in reducing the depth dimension of the cathode ray tube, as compared with the case with a plurality of electron guns arranged in the horizontal direction. In this respect, the multiple-gun configuration is more preferable in the interest of the gist of the present invention.

Furthermore, the embodiment discloses the case where the slits 106 in the color selecting member 103 extend longitudinally across the right and left ends thereof and have no vertical beam-shape pattern in a midpoint thereof. However, it is needless to say that the present invention is not limited to the color selecting member having such full slits.

Depending on the material, outer shape dimension, thickness, and the like of the color selecting member, there may be a case where the mechanical strength has to be reinforced in order to keep the shape of a metal pattern 111 in stripes formed in the color selecting member 103. In such a case, there may be provided a very thin bridge pattern connecting the vertically adjacent stripes of the metal pattern 111 with each other, so that the bridge pattern can effectively reinforce the mechanical strength of the metal pattern 111, the bridge pattern having a width and a pitch which hardly exerts an adverse influence on the passage of the electron beams. It is evident that the present invention can be applied to a color selecting member having such a bridge pattern and a cathode ray tube using the color selecting member.

As described above, according to the cathode ray tube or the method of manufacturing the cathode ray tube of the invention, the slit in the color selecting member are elongated in the longitudinal direction of the color selecting member, that is, in the same direction as the longitudinal direction of the front panel, while the phosphor layer has a pattern in stripes corresponding to the shape of the slit in the color selecting member. This enables the manufacture of the color selecting member with high accuracy without a defect by using an existing simple-structured projection aligner. This also eliminates the problem of occurrence of defective display or display failure due to relative deviation of the positions of an electron beam striking a phosphor at a certain incident angle, a slit in a color selecting member for allowing the electron beam to pass through, and a phosphor. Thereby, the cathode ray tube or the method of manufacturing the cathode ray tube can expect high picture quality.

According to the color selecting member for the cathode ray tube or the method of manufacturing the color selecting member for the cathode ray tube of the invention, even in case of the thermal expansion of the color selecting member when the cathode ray tube is put to practical use, there occurs no misregistration in the peripheral area nor non uniform display between the central area and the peripheral area of the screen. This enables high picture quality constantly.

Obviously many modifications and variations of the present invention are possible in the light of the above teachings. It is therefore to be understood that within the scope of the appended claims that invention may be practiced otherwise than as specifically described.

What is claimed is:

1. A cathode ray tube comprising:

an electron gun for emitting an electron beam for scanning;

a panel disposed so that a back side of the panel faces the electron gun;

a color selecting member formed of a single layer and disposed between the back side of the panel and the electron gun and having a slit elongated in a same direction as a longitudinal direction of a shape of the panel, thereby allowing the electron beam for scanning to pass through the slit; and a phosphor layer provided on the back side of the panel and having a pattern in stripes corresponding to a shape of the slit in the color selecting member so as to be irradiated with the electron beam passed through the slit in the color selecting member, wherein the electron beam passes through the slit last before irradiating the phosphor layer, wherein a plurality of electron guns are arranged linearly in the longitudinal direction of the shape of the panel.

2. The cathode ray tube according to claim 1, wherein the electron gun comprises three electron beam emitters arranged in a line and corresponding respectively with three primary colors.

3. The cathode ray tube according to claim 1, wherein a scan direction of the electron beam emitted by the electron gun is orthogonal to the elongated direction of the slit in the color selecting member.

* * * * *